US006558124B2

(12) United States Patent
Bucher et al.

(10) Patent No.: US 6,558,124 B2
(45) Date of Patent: May 6, 2003

(54) TIGHTENING DEVICE WITH EASY ALIGNMENT FOR SECURING A CEILING FAN TO A FITTING

(75) Inventors: Charles E. Bucher, Valrico, FL (US); John C. Bucher, Ft. Lauderdale, FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 82 days.

(21) Appl. No.: 09/747,502

(22) Filed: Dec. 21, 2000

(65) Prior Publication Data

US 2001/0022937 A1 Sep. 20, 2001

Related U.S. Application Data

(63) Continuation-in-part of application No. 09/408,452, filed on Sep. 20, 1999, now abandoned, and a continuation-in-part of application No. 09/408,451, filed on Sep. 20, 1999, now Pat. No. 6,171,062.

(51) Int. Cl.[7] ..... F04D 29/64

(52) U.S. Cl. ..... 416/244 R; 416/5; 416/170 R; 417/360; 417/423.15; 246/343

(58) Field of Search ..... 416/5, 170 R, 416/244 R, 246; 417/360, 423.15; 362/96, 404; 248/342, 343, 344

(56) References Cited

U.S. PATENT DOCUMENTS 5,613,832 A * 3/1997 Su ..... 416/244 R
5,947,436 A * 9/1999 Bucher et al. ..... 248/345
6,171,062 B1 * 1/2001 Bucher et al. ..... 416/244 R

* cited by examiner

*Primary Examiner*—Christopher Verdier
(74) *Attorney, Agent, or Firm*—Holland & Knight LLP

(57) ABSTRACT

A tightening device with easy alignment is adapted for securing a ceiling fan to a fitting which is used to mount the ceiling fan onto a flat ceiling wall, and includes an annular flange member extending inwardly and radially from a lower annular wall of a protective covering member in the form of a canopy, and an anchored flat sheet formed with an upper major wall of a motor casing. The anchored flat sheet has an inner peripheral wall, and a plurality of first fastening positions proximate to the inner peripheral wall and angularly spaced apart from one another. An upper annular clamping member has an outer circumferential portion, and an inner circumferential portion extending inwardly and radially from the outer circumferential portion. When the clamping member is placed on the annular flange member, the outer circumferential portion will sandwich the annular flange member to the anchored flat sheet. The inner circumferential portion defines second fastening positions respectively corresponding to the first fastening positions in terms of number and relative position and aligning with the same axially. A plurality of fastening members fasten the anchored flat sheet and the inner circumferential portion together along the first and second fastening positions.

27 Claims, 9 Drawing Sheets

TIGHTENING DEVICE WITH EASY ALIGNMENT FOR SECURING A CEILING FAN TO A FITTING

CROSS-REFERENCE TO RELATED APPLICATIONS

This application is a continuation-in-part of application Ser. No. 09/408,452, filed Sep. 20, 1999, now abandoned and application Ser. No. 09/408,451, filed Sep. 20, 1999, now U.S. Pat. No. 6,171,062, the entirety of both of such applications are hereby incorporated by reference herein.

BACKGROUND OF THE INVENTION

1. Field of the Invention

This invention relates to ceiling fans. More particularly, this invention relates to a tightening device with easy alignment adapted for securing a ceiling fan to a fitting which is used to mount the ceiling fan onto a flat ceiling wall.

2. Description of the Background Art

Referring to FIGS. 1 and 2, a first conventional ceiling fan 1 is shown to include a motor casing 13 having an upper major wall 132 with a plurality of screw holes 131 (typically 6 holes 131 equally spaced angularly) and an upright coupling member 16 including threaded holes 162 (typically 6 holes 162 equally spaced angularly) that are in alignment with holes 131 for coupling together by screws 161 (typically 6 screws 161). A fitting 10 includes a mounting bracket 11 which has an abutment wall 111 to be fixed on and to abut against a flat ceiling wall, and, for alternative use with a downrod 15 such as shown in FIG. 3, a pair of retaining halves 112 that are suspended from the abutment wall 111 and that are spaced apart from each other radially to define a retaining bore or socket for receiving the downrod 15. The fitting 10 further includes a protective canopy covering member 12 which has an upper annular secured portion 124 surrounding and secured to the abutment wall 111 of the mounting bracket 11 so as to shield the abutment wall 111 radially, and a skirt portion 125 circumferentially extending from the annular secured portion 124 about the axis and downwardly to form a lower annular wall 121. The lower annular wall 121 extends inwardly and radially to define an opening 123 for passage of the upright coupling member 16, and has a plurality of through holes 122 (typically 3 equally spaced in alignment with 3 of the holes 162) such that 3 of the screws 161 may be utilized to fasten the protective covering 12 to the motor casing 13.

Referring to FIGS. 3 and 4, for holding a second ceiling fan 2 with a supporting rod 15 which extends upwardly about the axis from the upright coupling member 16 and which has an enlarged upper portion that passes through the opening 123 and that is retained by the retaining halves 112 of the mounting bracket 11, the fitting 10 incorporates a plurality of cap members 17 to cover the through holes 122 in the protective covering member 12, thereby improving the outer appearance of the ceiling fan. A more complete disclosure of cap members 17 can be found in U.S. Pat. No. 5,947,436, the disclosure of which is hereby incorporated by reference herein.

Therefore, it is an object of this invention to provide an improvement which overcomes the aforementioned inadequacies of the prior art devices and provides an improvement which is a significant contribution to the advancement of the ceiling fan art.

Another object of this invention is to provide a tightening device with easy alignment adapted for securing a ceiling fan to a fitting so as to conveniently assemble the ceiling fan onto the fitting.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a tightening device which includes an annular flange member adapted to extend inwardly and radially from a lower annular wall of a protective covering member in the form of a canopy, and an anchored flat sheet adapted to be formed with an upper major wall of a motor casing. The anchored flat sheet has upper and lower anchored walls opposite to each other in an axial direction, and an inner peripheral wall extending from the upper anchored wall to communicate with the lower anchored wall to define a central hole. The upper anchored wall defines a plurality of first fastening positions proximate to the inner peripheral wall and angularly spaced apart from one another. An upper annular clamping member preferably in the form of a clamping ring has an outer circumferential portion and an inner circumferential portion extending inwardly and radially from the outer circumferential portion to define an inserting hole. A similarly configured lower annular gasket member, preferably composed of a vibration damping material such as rubber, is provided. When the upper annular clamping member and the gasket member are respectively placed on and beneath the annular flange member, the outer circumferential portions will sandwich the annular flange member therebetween, while the inner circumferential portions face each other in an axial direction parallel to the axis. The inner circumferential portions respectively define second fastening positions and third fastening positions which respectively correspond to the first fastening positions in terms of number and relative position. As such, a plurality of fastening members can fasten the anchored flat sheet and the inner circumferential portions together along the first, second and third fastening positions when the annular flange member is sandwiched between the outer circumferential portions, and when each of the first fastening positions is aligned with two corresponding ones of the second and third fastening positions in the axial direction.

The present invention eliminates the need for holes in the protective canopy covering member that otherwise may be covered by the aesthetically pleasing cap members described hereinabove.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
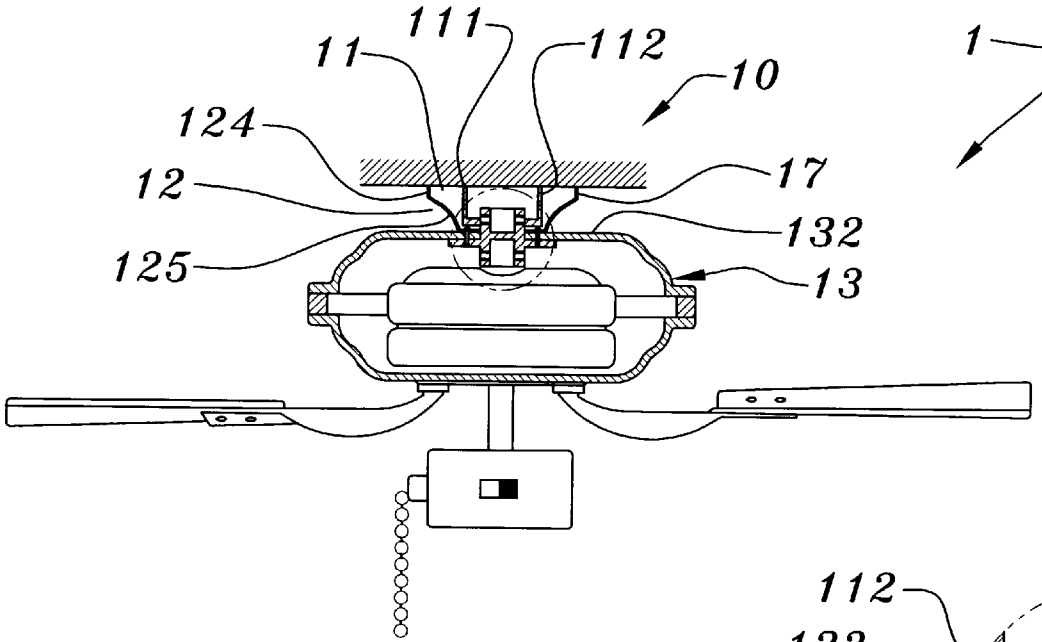
FIG. 1 Prior Art
FIG. 1 is a schematic view of a conventional ceiling fan when mounted to a ceiling wall.
Figure 2:
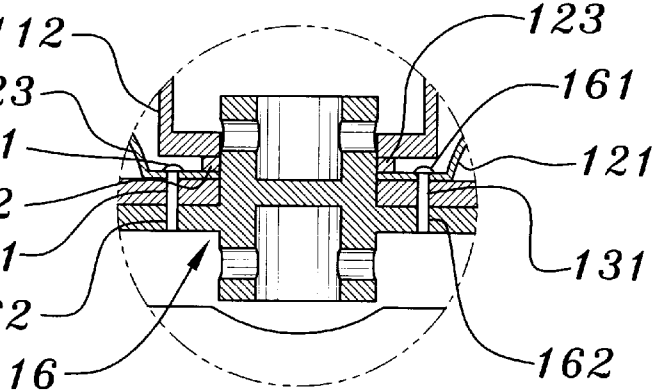
FIG. 2 Prior Art
FIG. 2 is an enlarged view of an encircled portion in FIG. 1.

For ease of understanding, the same reference numerals are used for equivalent components in the following description of the preferred embodiment.

Figures 5, 5A:
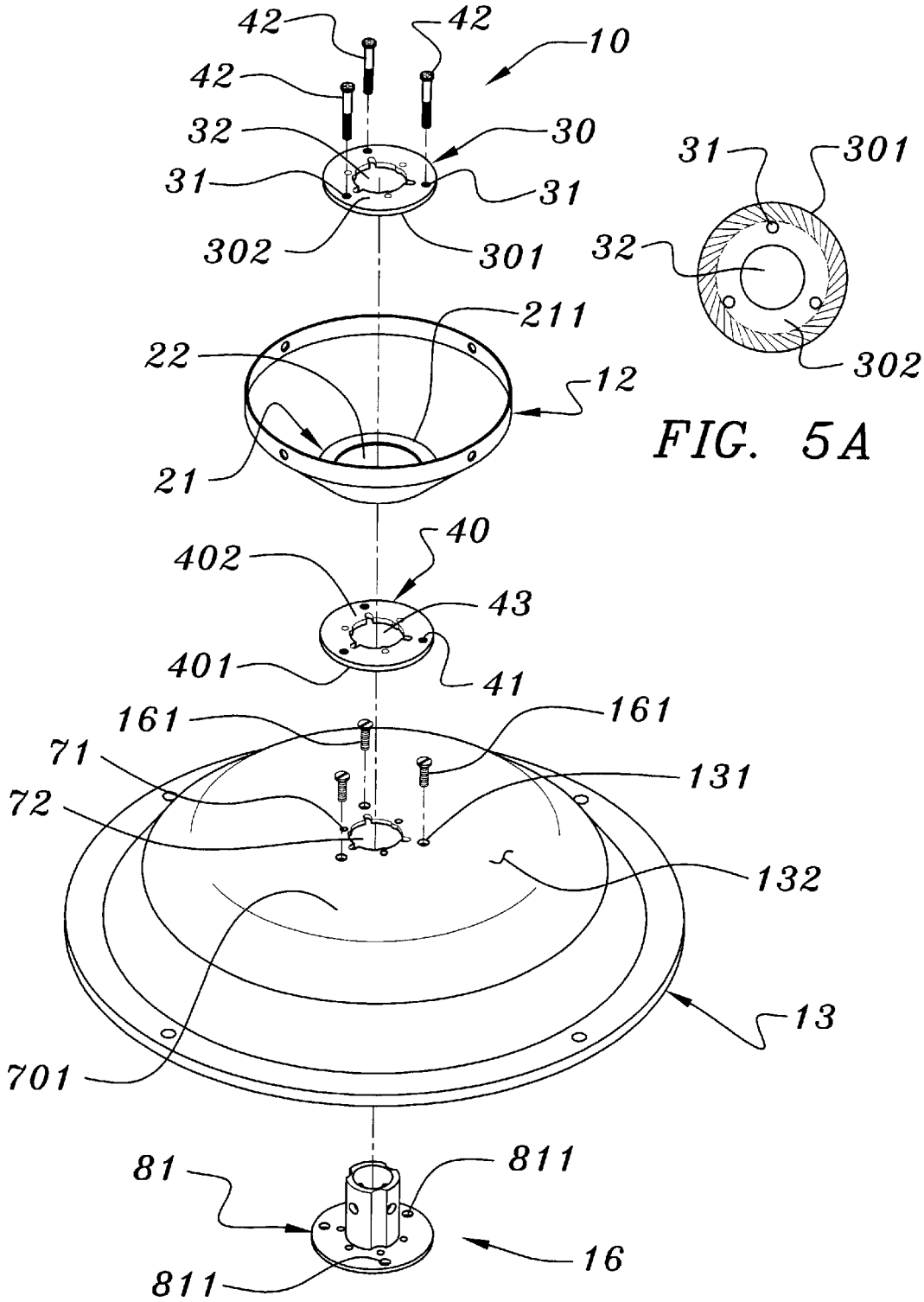
FIG. 5 is an exploded view of a preferred embodiment of a tightening device according to this invention.
FIG. 5*a* is a top view of an upper clamping member.
Figure 7:
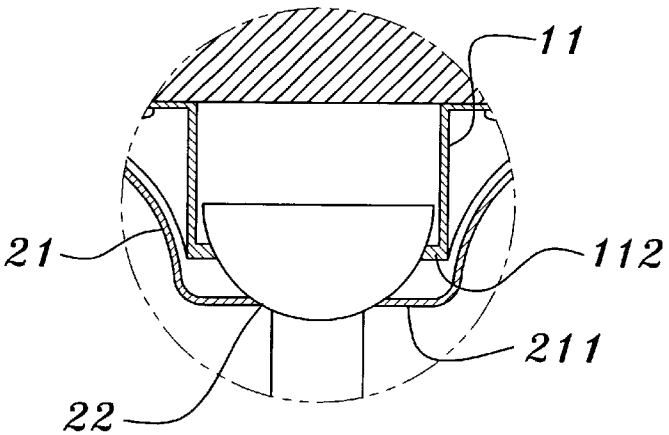
FIG. 7 is an enlarged view of an encircled portion in FIG. 6.
Figure 6:
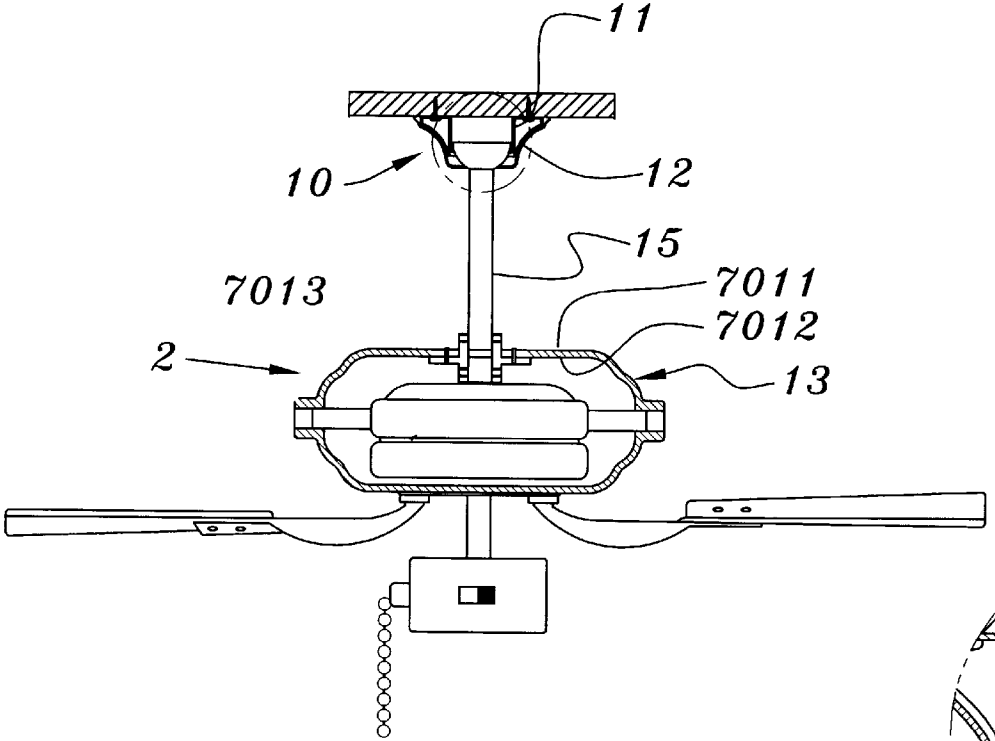
FIG. 6 is a schematic view showing how the tightening device secures a ceiling fan to a fitting.

Referring to FIGS. 5, 6 and 7, the preferred embodiment of the tightening device according to the present invention is shown to comprise an annular flange member 211 which extends inwardly and radially relative to a second axis from the lower annular wall 21 of the protective covering member 12 to define a center hole 22 having an annular edge.

An anchored flat sheet 701 is formed with the upper major wall of the motor casing 13, and has upper and lower anchored walls 7011, 7012 opposite to each other in an axial direction parallel to a first axis of the rotor shaft of the ceiling fan 2. An inner peripheral wall 7013 extends from the upper anchored wall 7011 in the axial direction to communicate with the lower anchored wall 7012 to define a central hole 72. In addition, the upper anchored wall 7011 defines a plurality of first screw holes 71 which are proximate to the inner peripheral wall 7013 and which are angularly spaced apart from one another.

An upper annular clamping member and a lower annular gasket member, both preferably in the form of rings 30, 40, have outer circumferential portions 301, 401 which surround a third axis, and inner circumferential portions 302, 402 which extend inwardly and radially from the outer circumferential portions 301, 401 to define inserting holes 32, 43, respectively. The inner circumferential portions 302, 402 respectively have second and third through holes 31, 41 which respectively correspond to the first screw holes 71 in terms of number and relative position.

Figure 4:
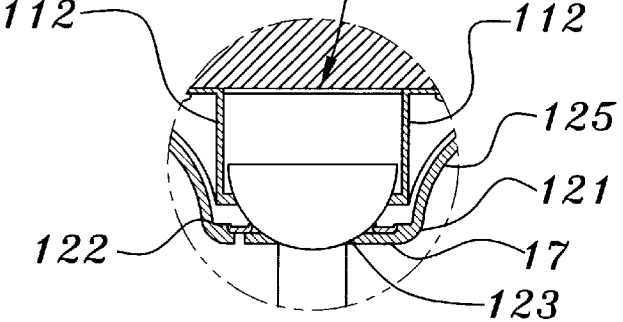
FIG. 4 Prior Art
FIG. 4 is an enlarged view of an encircled portion in FIG. 3.
Figure 3:
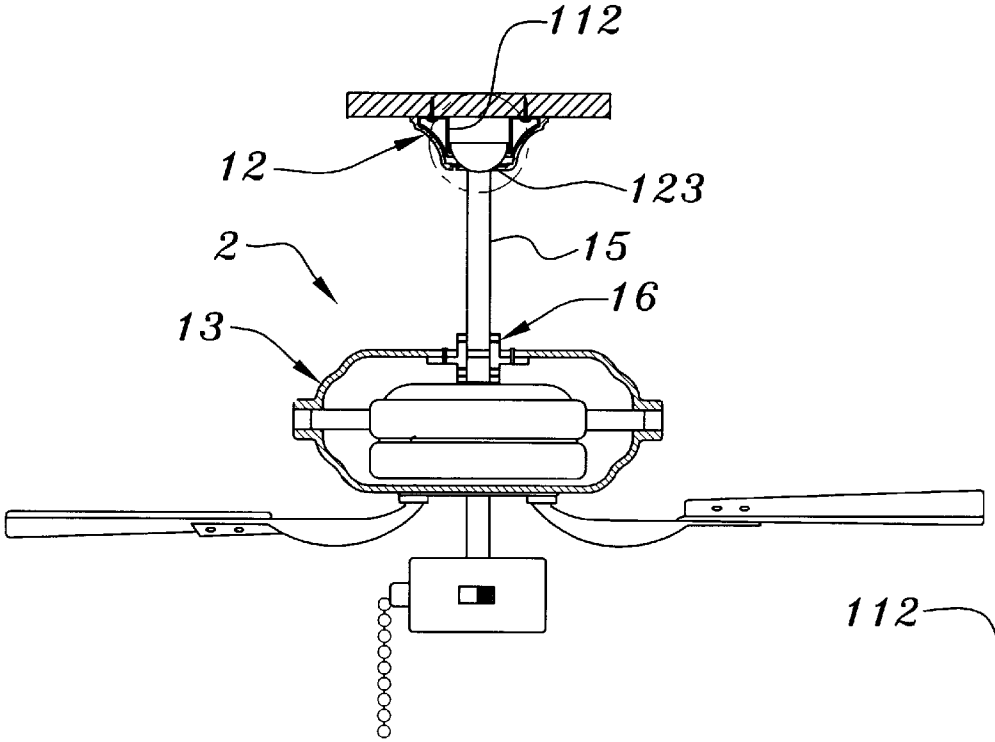
FIG. 3 Prior Art
FIG. 3 is a schematic view of another conventional ceiling fan when mounted to a ceiling wall.

Referring to FIGS. 6 and 7, when the tightening device is used to secure the ceiling fan 2 to the fitting 10, the ceiling fan 2, in the known manner as shown in FIG. 3, has the supporting rod 15 which can pass through the opening 22, and the enlarged end portion thereof is retained between the retaining halves 112 of the mounting bracket 11. Since there are no through holes formed in the protective covering member 12, the cap members 17 shown in FIG. 4 are not required.

Figure 8:
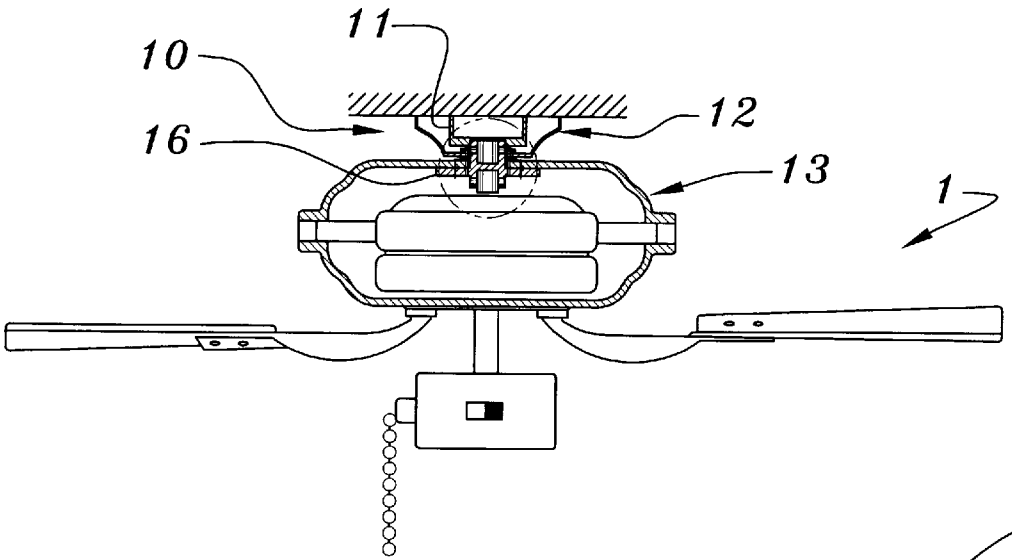
FIG. 8 is an assembled view of FIG. 5.
Figure 9:
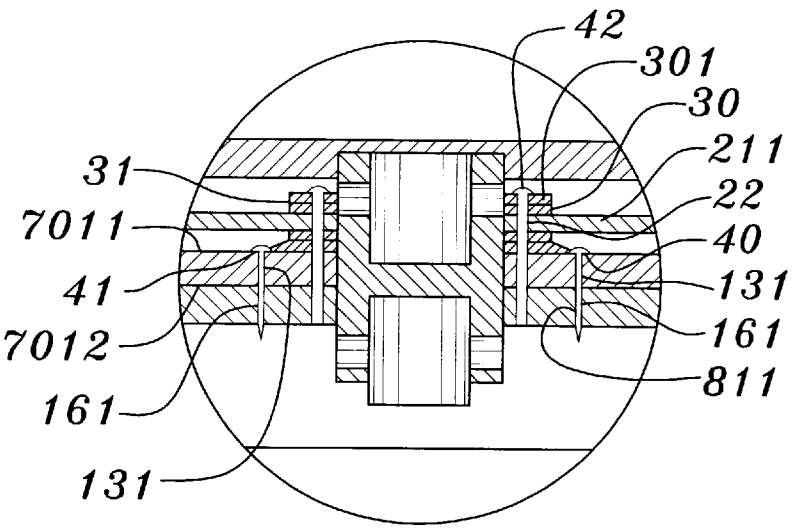
FIG. 9 is an enlarge view of an encircled portion of FIG. 8.
Figure 10:
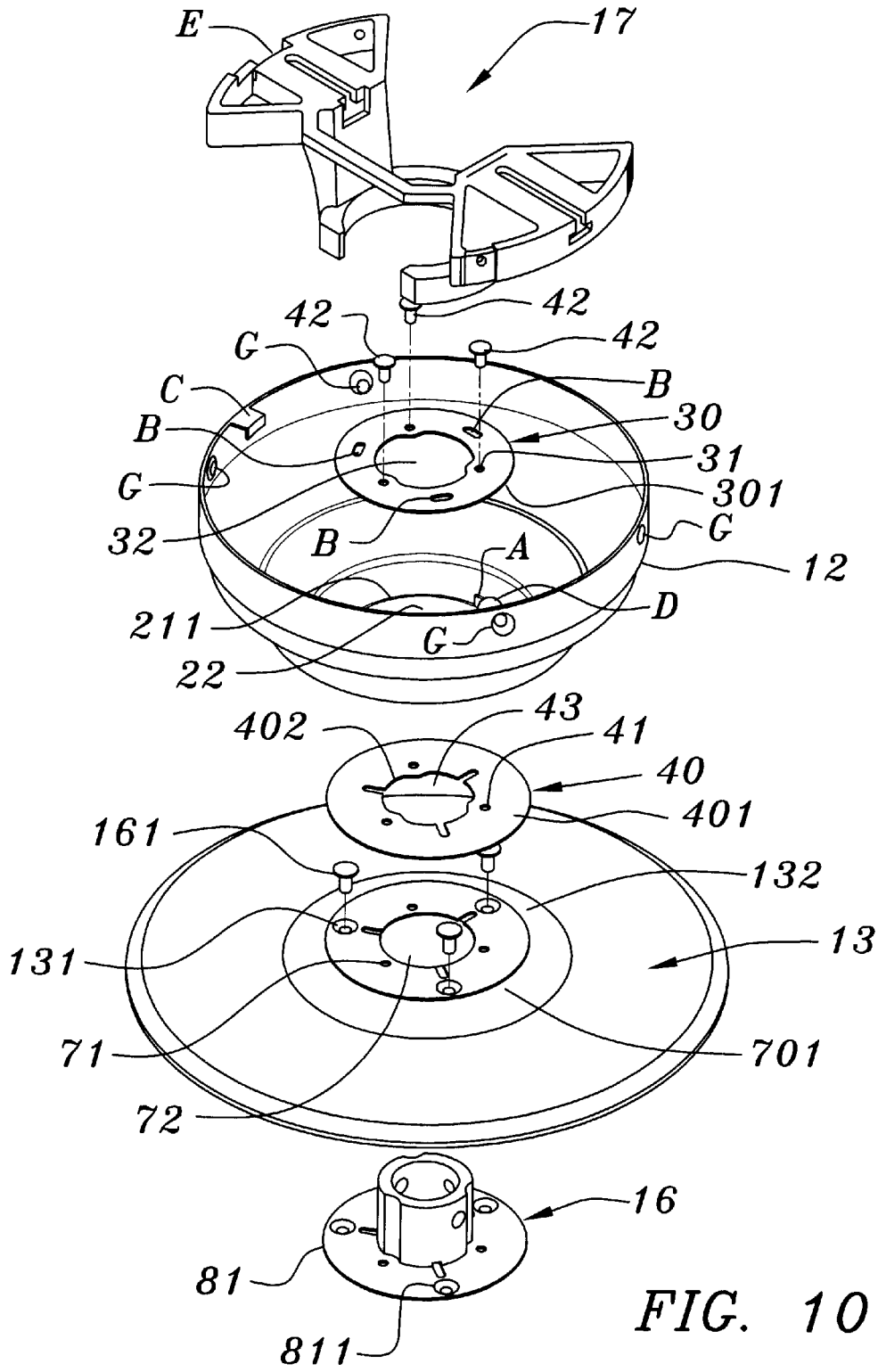
FIG. 10 is an exploded view of a most preferred embodiment of a tightening device according to the invention.

Referring to FIGS. 5, 8 and 9, when the tightening device is used to secure another ceiling fan 1 to the fitting 10, the upper and lower annular clamping and gasket members 30, 40 are respectively placed on and beneath the annular flange member 211 to bring the second axis to coincide with the third axis such that the outer circumferential portions 301, 401 sandwich the annular flange member 211 and the inner circumferential portions 302, 402 face each other in an axial direction parallel to the second axis. The coupling member 16, having plate 81 and mounting holes 811, of the ceiling fan 2, from bottom to top, passes through the central hole 72, the inserting hole 43, the opening 22, and the inserting hole 32, and is in a splined connection with the annular clamping and gasket members 30, 40. In this state, the first axis coincides with the second and third axes, and the first screw holes 71 are aligned with the second and third through holes 31, 41 in the axial direction. As such, a plurality of screw fasteners 42 can respectively pass through the aligned second and third through holes 31, 41 and engage threadedly the corresponding screw holes 71 to fasten the anchored flat sheet 701 and the inner circumferential portions 302, 402 together. As shown in FIGS. 8 & 9, preferably, each of the screw fasteners 42 abuts against the annular flange member 211 radially for facilitating the securing effect of the same.

As illustrated, by virtue of the upper and lower annular clamping and gasket members 30, 40, there is no need to form through holes in the protective covering member 12 for connecting with the motor casing 13, thereby eliminating the need for cap members that can affect the outer appearance of the protective covering member 12. Moreover, the tightening member of this invention is suitable for use with two types of conventional ceiling fans.

As noted above, FIGS. 5–9 illustrate a preferred embodiment of the invention. However, since the original filing of the parent application, it has been discovered that the upper annular clamping member or ring 30 may tend to twist relative to the protective covering member or canopy 12. Accordingly, a most preferred embodiment has been developed to preclude any relative twisting between the ring 30 and the canopy 12. This most preferred embodiment is illustrated in FIGS. 10–16.

More particularly, in the most preferred embodiment of the invention, canopy 12 comprises a plurality (e.g., three)

of upstanding protrusions or locking tabs A that extend from the edge 211 of the opening 22 formed in the canopy 12. For ease in manufacturing, the upstanding locking tabs A may be formed during punching of the opening 22 during manufacture and then turned upwardly from the edge of the hole 211 to an upstanding orientation.

The clamping member or ring 30 is similar in configuration to that of the preferred embodiment described hereinabove; however, ring 30 further includes a plurality (e.g., three) apertures or locking slots B. Slots B are disposed at radial orientations relative to the locking tabs A to be in alignment therewith. Accordingly, during assembly of the ring 30 to the canopy 12, the locking tabs A fit into the locking slots B. Upon complete assembly, such as shown in FIGS. 11 and 12, it is seen that the locking engagement of the tabs A into slots B preclude any relative twisting of the canopy 12 relative to the ring 30 once fasteners 42 are tightened to securely clamp the canopy, the lower annular clamping member or ring 40 and motor housing 13 to the coupling member 16.

In our co-pending application entitled "Fitting Adapted for Holding an Upright Coupling Member Disposed in a Motor Casing Onto a Flat Ceiling Wall", Ser. No. 09/408,451, filed Sep. 20, 1999, the disclosure of which is hereby incorporated by reference herein, we disclosed a novel apparatus and method for mounting the canopy 12 to the mounting frame or bracket 17. This mounting apparatus and method may be easily used in conjunction with either of the embodiments of the present invention as shown in FIGS. 11–16.

Figure 12:
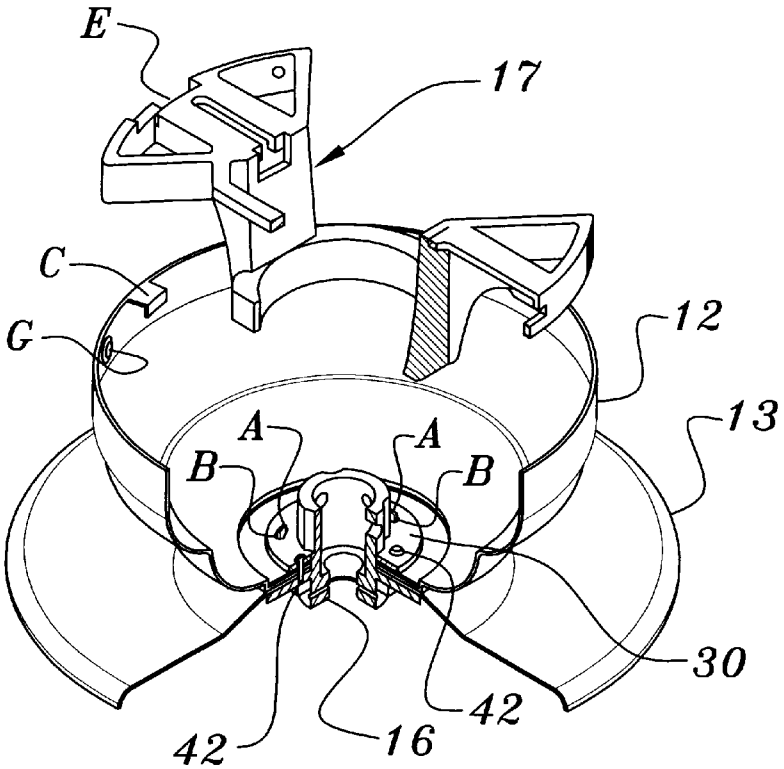
FIG. 12 is a top perspective view of the most preferred embodiment of the invention.
Figure 11:
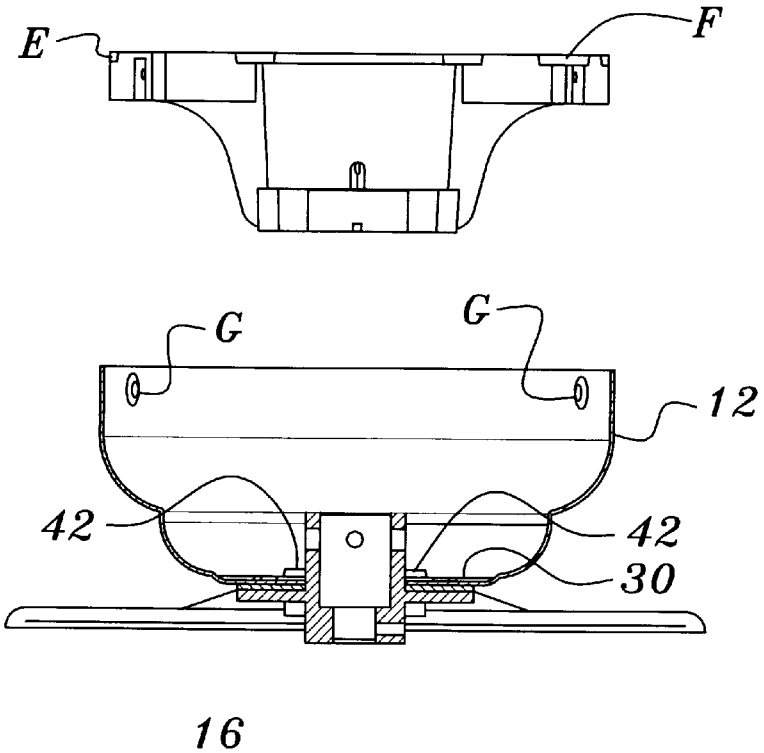
FIG. 11 is an exploded, cross-sectional view of the most preferred embodiment of the invention of FIG. 10.
Figure 14:
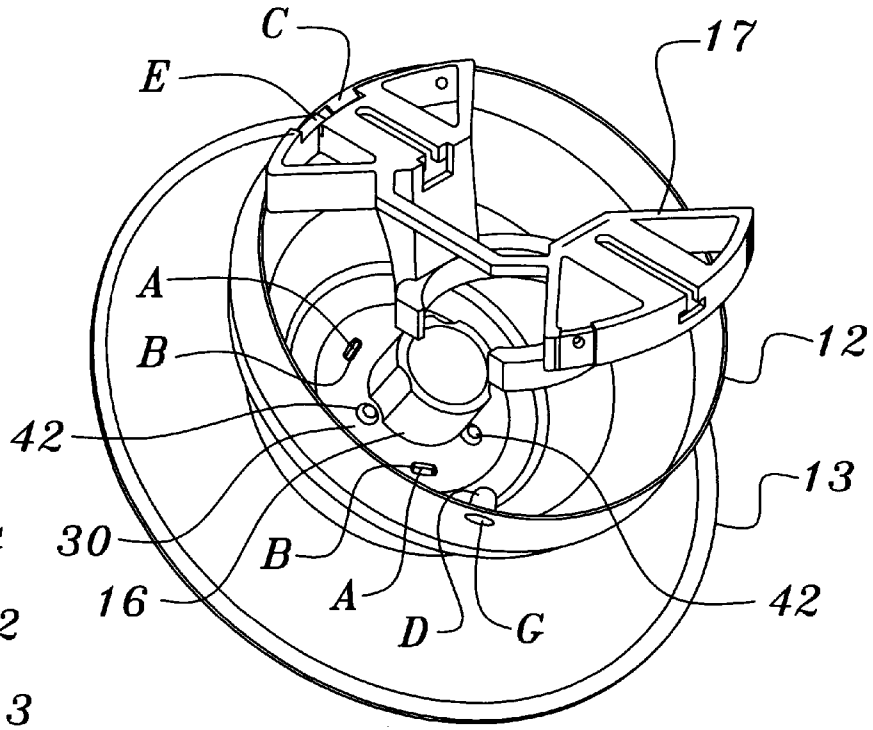
FIGS. 13 and 14 are side and perspective views, respectively, of the most preferred embodiment of the invention showing the manner in which the ceiling fan canopy may be suspended from the ceiling fan bracket to facilitate wiring of the fan.
Figure 13:
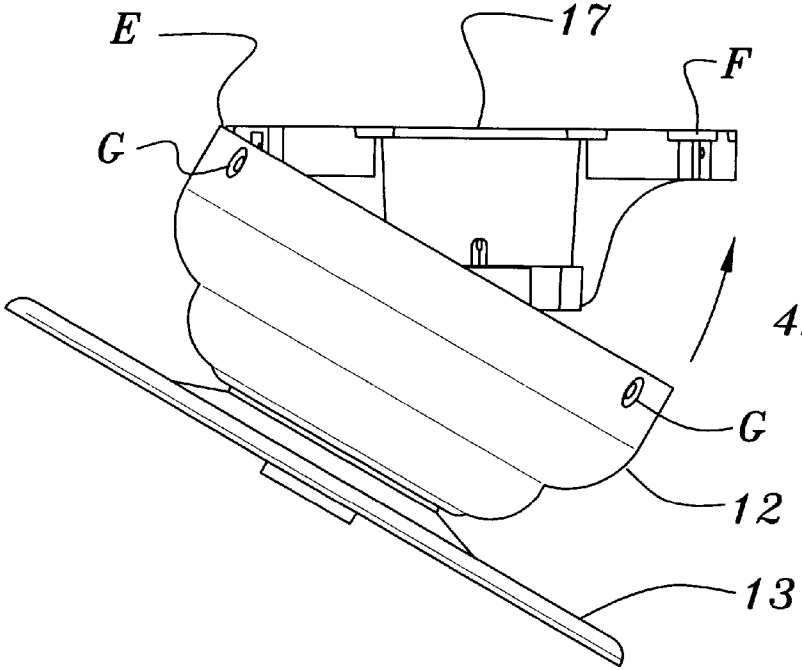
Figures 15, 16:
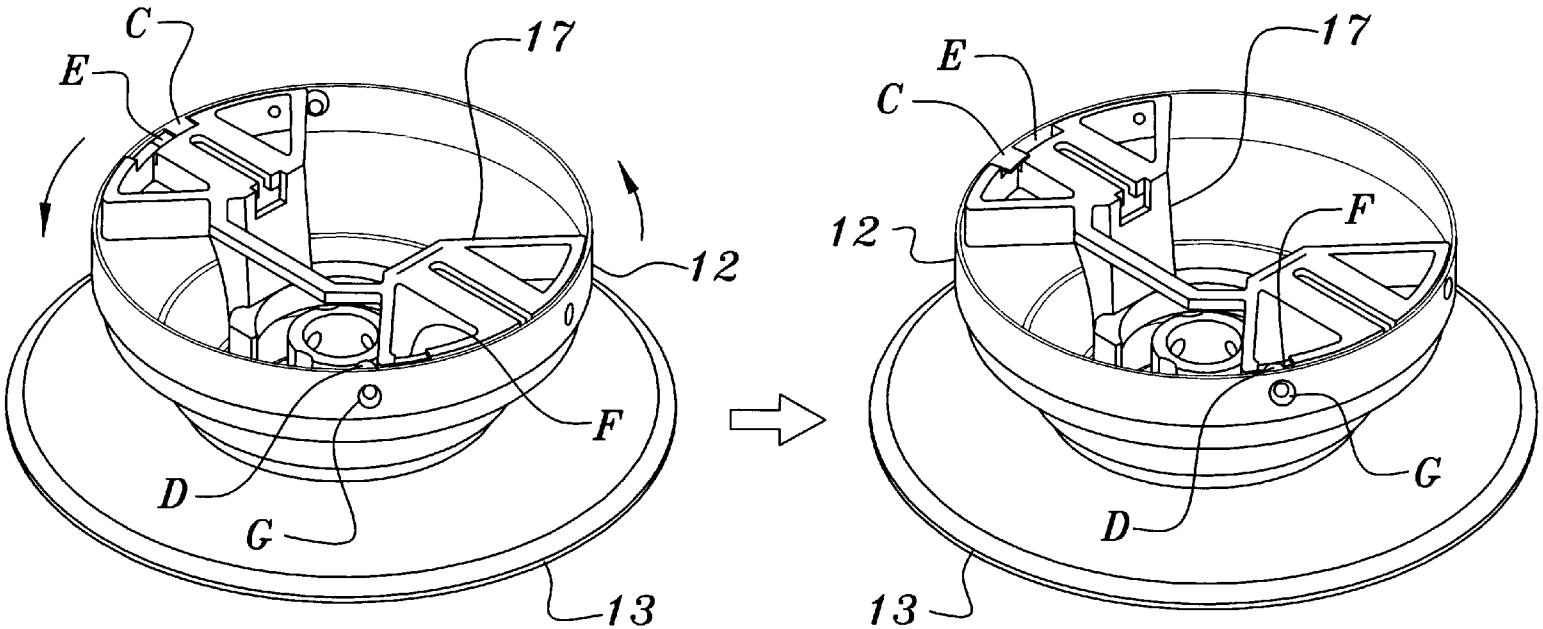
FIGS. 15 and 16 are top perspective views of the most preferred embodiment of the invention showing the manner in which the canopy is fully assembled to the fan bracket by a twisting motion.

More particularly, as shown in FIGS. 11 and 12, canopy 12 comprises an anchor portion or hook C and a supported portion or tab D. During assembly, hook C is positioned within an anchoring seat E of the bracket 17 allowing the canopy 12 and motor housing 13 to be suspended from the bracket 17, thereby conveniently allowing the ceiling fan to be wired to the household wiring (see FIGS. 13 and 14).

After wiring, the canopy 12 is pivotally tilted upwardly to a position flush with the ceiling and is rotated such that the tab D engages within a positioning wall or rest F, whereupon the canopy 12 may then be permanently secured into position by means of threaded fasteners that engage through holes G in the upper rim of the canopy into the hanger bracket 17.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A tightening device adapted for securing a ceiling fan to a fitting which is used to mount the ceiling fan onto a flat ceiling wall, the ceiling fan including a motor casing with an upper major wall, a rotor shaft disposed in and rotatable relative to the motor casing about a first axis, and an upright coupling member disposed in the motor casing and extending outwardly of the upper major wall of the motor casing along the first axis, the fitting including (a) a mounting bracket which has an abutment wall to be fixed on and to abut against the ceiling wall, and a pair of retaining halves suspended from the abutment wall, and spaced apart from each other in a radial direction relative to the first axis to define a retaining bore for receiving the upright coupling member, and (b) a protective covering member which has an upper annular secured portion surrounding and fixedly secured to the abutment wall of the mounting bracket so as to shield the abutment wall radially, and a skirt portion circumferentially extending from the annular secured portion about a second axis and downwardly to form a lower annular wall, said tightening device comprising:

(a) an annular flange member adapted to extend inwardly and radially from the lower annular wall of the protective covering member to define an opening with a first dimension which is adapted for passage of the upright coupling member;

(b) an anchored flat sheet adapted to be formed with the upper major wall of the motor casing, and having upper and lower anchored walls opposite to each other in an axial direction parallel to the first axis, said anchored flat sheet further having an inner peripheral wall which extends from said upper anchored wall in the axial direction to communicate with said lower anchored wall to define a central hole that is adapted for passage of the upright coupling member, said upper anchored wall defining a plurality of first fastening positions which are proximate to said inner peripheral wall and which are angularly spaced apart from one another;

(c) an upper annular clamping member having an outer circumferential portion surrounding a third axis, and an inner circumferential portion which extends inwardly and radially from said outer circumferential portion to define an inserting hole that is adapted for insertion of the upright coupling member to bring the third axis to coincide with the first axis, said upper annular clamping member being of a dimension such that when said upper annular clamping member is placed on said annular flange member to bring the second axis to coincide with the third axis, said outer circumferential portion will couple sandwich said annular flange member thereto, said inner circumferential portion of said upper annular clamping member defining second fastening positions which correspond to said first fastening positions in terms of number and relative position; and (d) a plurality of fastening members, each disposed to fasten said anchored flat sheet and said inner circumferential portion of said upper annular clamping member together along said first and second fastening positions when said annular flange member is sandwiched between said outer circumferential portion, and when each of said first fastening positions is aligned with corresponding ones of said second fastening positions in the axial direction.

2. The tightening device as claimed in claim 1, wherein each of said first fastening positions is a screw hole extending from said upper anchored wall in the axial direction to communicate with said lower anchored wall, each of said second fastening positions and third fastening positions being a through hole disposed in said inner circumferential portion and extending in the axial direction, each of said fastening members being a screw fastener passing through corresponding ones of said through holes in said upper clamping member, and engaging threadedly a corresponding one of said screw holes in said anchored flat sheet.

3. The tightening device as claimed in claim 2, wherein said corresponding ones of said through holes in said upper annular clamping member are located in said inner circumferential portion such that said screw fasteners abut against said annular flange member in the radial direction when said screw fasteners pass through said corresponding ones of said through holes.

4. The tightening device as claimed in claim 1, wherein said anchored flat sheet and said upper annular clamping member are adapted to be in a splined connection with the upright coupling member.

5. The tightening device as claimed in claim 1, further comprising an annular tightening seat member adapted to extend radially and outwardly from the upright coupling member so as to abut against said lower anchored wall when the upright coupling member is brought to pass through said central hole, said annular tightening seat member defining a plurality of third fastening positions which correspond to said first fastening positions in terms of number and relative position.

6. The tightening device as claimed in claim 5, wherein each of said first fastening positions is a through hole extending from said upper anchored wall in the axial direction to communicate with said lower anchored wall, each of said second fastening positions being a through hole which is disposed in said inner circumferential portion and which extends in the axial direction, each of fourth fastening positions being a screw hole which is disposed in said annular tightening seat member in the radial direction and which is aligned with corresponding ones of said through holes, each of said fastening members being a screw fastener which passes through said corresponding ones of said through holes in said upper annular clamping member and said annular flange member, and which engages threadedly a corresponding one of said screw holes in said annular tightening seat member.

7. A ceiling fan, comprising in combination:

a motor housing containing a ceiling fan motor;

a ceiling fan bracket for mounting relative to a ceiling;

a ceiling fan canopy including a center hole, said canopy being adapted for coupling to said bracket; and a clamping member for positioning on an upper edge of said center hole of said canopy and at least one fastener clamping said clamping member about said edge, said fastener interconnecting said clamping member relative to said motor housing, whereby said clamping member allows said canopy to be secured to said motor housing whereupon said canopy may then be mounted to the ceiling by said mounting bracket.

8. The ceiling fan as set forth in claim 7, wherein said clamping member comprises a clamping ring and wherein said edge comprises an annular edge of said center hole, whereby said clamping ring may be clamped about said annular edge and then secured relative to said motor housing.

9. The ceiling fan as set forth in claim 8, further including a coupling member mounted to said motor housing and wherein said fastener interconnects said clamping ring to said coupling member.

10. The ceiling fan as set forth in claim 9, wherein a center hole of said clamping ring includes at least one spline for mating engagement with at least one spline formed in said coupling member.

11. The ceiling fan as set forth in claim 10, wherein said fastener comprises a threaded fastener.

12. The ceiling fan as set forth in claim 7, further including a lower annular gasket member positioned between said canopy and said motor housing.

13. In a ceiling fan comprising a motor housing containing a ceiling fan motor, a ceiling fan bracket for mounting relative to a ceiling, a ceiling fan canopy including a center hole, said canopy being adapted for coupling to said bracket, the improvement comprising:

a clamping member for positioning on an upper edge of said center hole of said canopy and at least one fastener clamping said clamping member about said edge, said fastener further interconnecting said clamping member relative to said motor housing, whereby said clamping member allows said canopy to be secured to said motor housing whereupon said canopy may then be mounted to the ceiling by said mounting bracket.

14. An installation assembly for interconnecting a ceiling fan canopy having a center hole relative to a motor housing of a ceiling fan, the assembly comprising in combination:

a clamping member for positioning on an upper edge of the center hole of the canopy and at least one fastener clamping said clamping member about the edge, said fastener further interconnecting said clamping member relative to the motor housing, whereby said clamping member allows the canopy to be secured to the motor housing.

15. The assembly as set forth in claim 14, wherein said clamping member comprises a clamping ring and wherein the edge comprises an annular edge of the center hole, whereby said clamping ring may be clamped about the upper annular edge and then secured relative to the motor housing.

16. The assembly as set forth in claim 15, wherein the ceiling fan further includes a coupling member mounted to the motor housing and wherein said fastener interconnects said clamping ring to the coupling member.

17. The ceiling fan as set forth in claim 16, wherein a center hole of said clamping ring includes at least one spline for mating engagement with at least one spline formed in the coupling member.

18. The ceiling fan as set forth in claim 17, wherein said fastener comprises a threaded fastener.

19. The ceiling fan as set forth in claim 18, further including a gasket ring positioned between said canopy and said motor housing.

20. A ceiling fan, comprising in combination:

a motor housing containing a ceiling fan motor;

a ceiling fan bracket for mounting relative to a ceiling;

a ceiling fan canopy including a center hole, said canopy being adapted for coupling to said bracket; and a clamping member for positioning about said center hole of said canopy, said clamping member and said canopy including means for preventing relative twisting between said clamping member and said canopy; and a fastener interconnecting said clamping member relative to said motor housing, whereby said clamping member allows said canopy to be secured to said motor housing without twisting whereupon said canopy may then be mounted to the ceiling by said mounting bracket.

21. The ceiling fan as set forth in claim 20, wherein a protuberance extends from said canopy.

22. The ceiling fan as set forth in claim 20, further including an aperture positioned in alignment with a protuberance for engagement thereby.

23. The ceiling fan as set forth in claim 22, wherein said protuberance extends from said canopy and wherein said aperture is formed in said clamping member.

24. The ceiling fans as set forth in claim 23, wherein said protuberance comprises a tab and wherein said aperture comprises a slot, said tab being dimensioned to engage into said aperture.

25. The ceiling fan as set forth in claim 24, further including a plurality of said tabs positioned in alignment with a respective plurality of said slots.

26. In a ceiling fan comprising a motor housing containing a ceiling fan motor, a ceiling fan bracket for mounting relative to a ceiling, a ceiling fan canopy including a center hole, said canopy being adapted for coupling to said bracket, the improvement comprising:

a clamping member and fastener for clamping said canopy to said motor housing;

means for preventing relative twisting between said clamping member and said canopy.

27. An installation assembly for interconnecting a ceiling fan canopy having a center hole relative to a motor housing of a ceiling fan, the assembly comprising in combination:

a clamping member for positioning on an upper edge of the center hole of the canopy and at least one fastener clamping said clamping member about the edge, a protuberance extending between said clamping member and said canopy to prevent relative twisting therebetween, said fastener further interconnecting said clamping member relative to the motor housing, whereby said clamping member allows the canopy to be secured to the motor housing.

* * * * *